US009086255B1

(12) United States Patent
Berman

(10) Patent No.: US 9,086,255 B1
(45) Date of Patent: Jul. 21, 2015

(54) SYSTEM AND METHOD FOR AN INWARD-FOLDING PROTECTIVE TURRET

(71) Applicant: GRANITE TACTICAL VEHICLES INC., Mount Airy, NC (US)

(72) Inventor: Christopher Berman, Mount Airy, NC (US)

(73) Assignee: Granite Tactical Vehicles Inc., Mount Airy, NC (US)

( * ) Notice: Subject to any disclaimer, the term of this patent is extended or adjusted under 35 U.S.C. 154(b) by 0 days.

(21) Appl. No.: 13/965,977

(22) Filed: Aug. 13, 2013

Related U.S. Application Data

(60) Provisional application No. 61/682,588, filed on Aug. 13, 2012.

(51) Int. Cl.
*F41H 5/26* (2006.01)
*F41H 5/20* (2006.01)
*F41H 7/04* (2006.01)

(52) U.S. Cl.
CPC .. *F41H 5/20* (2013.01); *F41H 5/26* (2013.01); *F41H 7/048* (2013.01)

(58) Field of Classification Search
CPC ..... F41H 5/20; F41H 5/26; F41H 5/16; F41H 7/02; F41H 5/18; F41H 5/263; F41H 5/0407; F41H 7/048; F41A 27/18; F41A 23/20; F41A 27/10; F41A 27/24; F41A 9/11; F41A 9/13; A62C 3/07
USPC ..... 89/36.13, 36.14, 36.01, 36.03, 36.04, 89/36.07–36.09, 36.12–13, 36.15–36.16
See application file for complete search history.

(56) References Cited

U.S. PATENT DOCUMENTS

| | | | | |
|---|---|---|---|---|
| 5,105,714 | A * | 4/1992 | Sprafke et al. | 89/36.08 |
| 7,478,580 | B1 * | 1/2009 | Parimi et al. | 89/36.13 |
| 8,006,606 | B1 * | 8/2011 | Petrosillo et al. | 89/36.07 |
| 2009/0120274 | A1 * | 5/2009 | Schneider et al. | 89/36.08 |
| 2014/0083284 | A1 * | 3/2014 | Chu et al. | 89/36.02 |
| 2014/0230640 | A1 * | 8/2014 | Chu et al. | 89/36.08 |

* cited by examiner

*Primary Examiner* — Troy Chambers
*Assistant Examiner* — Bridget Cochran
(74) *Attorney, Agent, or Firm* — Orrick, Herrington & Sutcliffe LLP

(57) ABSTRACT

A protective turret is shown and described. In some embodiments the protective turret can include a turret base with a plurality of turret panels that are each rotatably coupled proximate to a portion of an edge of the turret base, the turret panels operable to assume an erected configuration with each of the turret panels extending away from the turret base and defining a turret compartment defined by a portion of the turret base and a portion of the plurality of turret panels, and the turret panels further operable to assume a collapsed configuration by each of the turret panels folding inward within the turret compartment toward the turret base.

17 Claims, 10 Drawing Sheets

Fig.6a
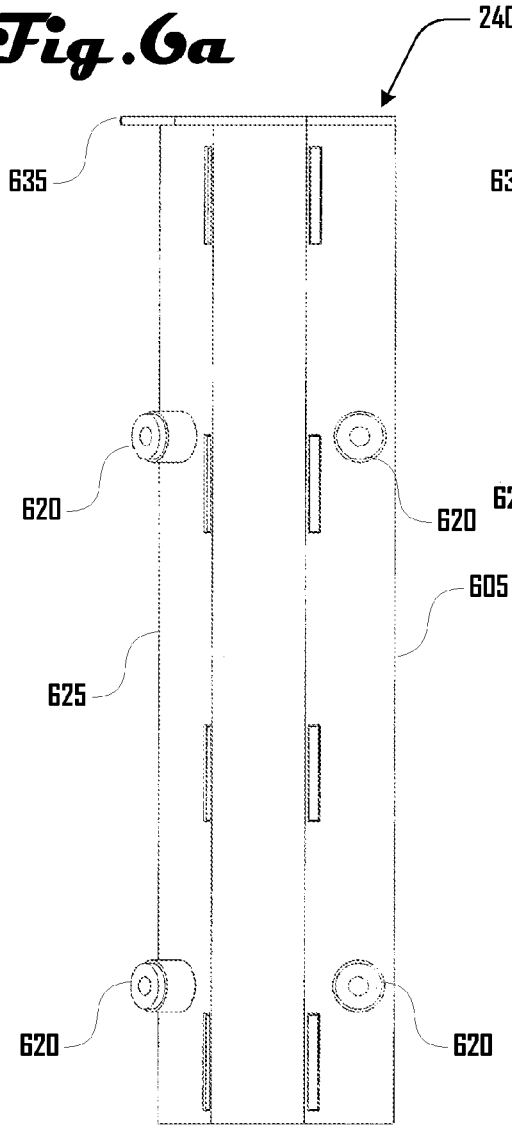
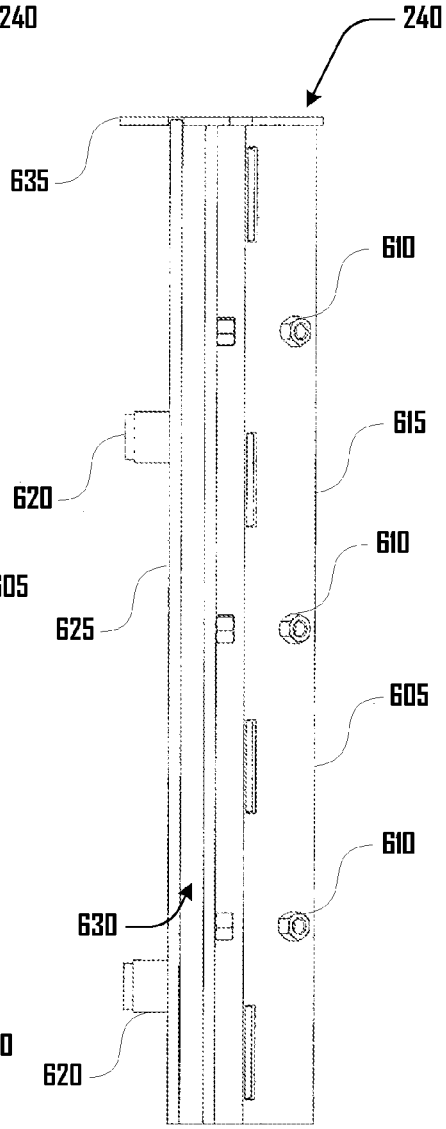
Fig.6b
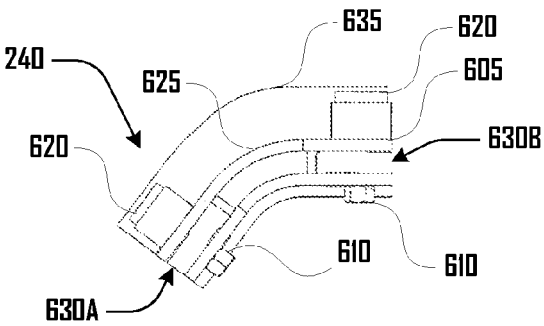
Fig.6c

SYSTEM AND METHOD FOR AN INWARD-FOLDING PROTECTIVE TURRET

CROSS-REFERENCE TO RELATED APPLICATIONS

This application claims the benefit of U.S. Provisional Application No. 61/682,588, filed Aug. 13, 2012, which application is hereby incorporated herein by reference in its entirety.

FIELD

The present disclosure relates generally to combat vehicles and more particularly, but not exclusively, to systems and methods for providing an inward-folding protective turret.

BACKGROUND

Combat vehicles such as the High Mobility Multipurpose Wheeled Vehicle (HMMWV) may be configured with a roof ring mount that allows various weapons systems to be mounted to the roof of the vehicle. Weapons systems including light and heavy machine guns, rockets, or missiles may be mounted to the top of a HMMWV. Additionally, such weapons systems may include or be surrounded by protective armor that shields a gunner or other personnel in the turret from hostile fire.

Many conventional turret armor systems are deficient because they are not configured, most importantly, to be rapidly assembled from a collapsed state and made ready for action, nor are they configured to quickly collapse and provide a reduced height for transportation. Such systems must be completely removed from a vehicle or have portions removed before transportation is possible.

However, some turret armor systems may provide for reduced height. For example, publication WO 2013/905732 (application PCT/US2012/056922 of BAE Systems) teaches an outward-folding gunner protection kit. Such a system is deficient because the outward folding armor panels may damage portions of a vehicle, may not be compatible with some vehicle configurations, and undesirably increase the width profile of a vehicle.

In view of the foregoing, a need exists for an inward-folding protective turret system for providing improved collapsibility in an effort to overcome the aforementioned obstacles and deficiencies of conventional protective turret systems.

BRIEF DESCRIPTION OF THE DRAWINGS

FIG. 6*a* is an exemplary side view drawing illustrating a coupling joint in accordance with an embodiment.

FIG. 6*b* is another exemplary side view drawing illustrating the coupling joint depicted in FIG. 6*a*.

FIG. 6*c* is an exemplary bottom view drawing illustrating the coupling joint depicted in FIGS. 6*a* and 6*b*.

Figures 1A, 1B:
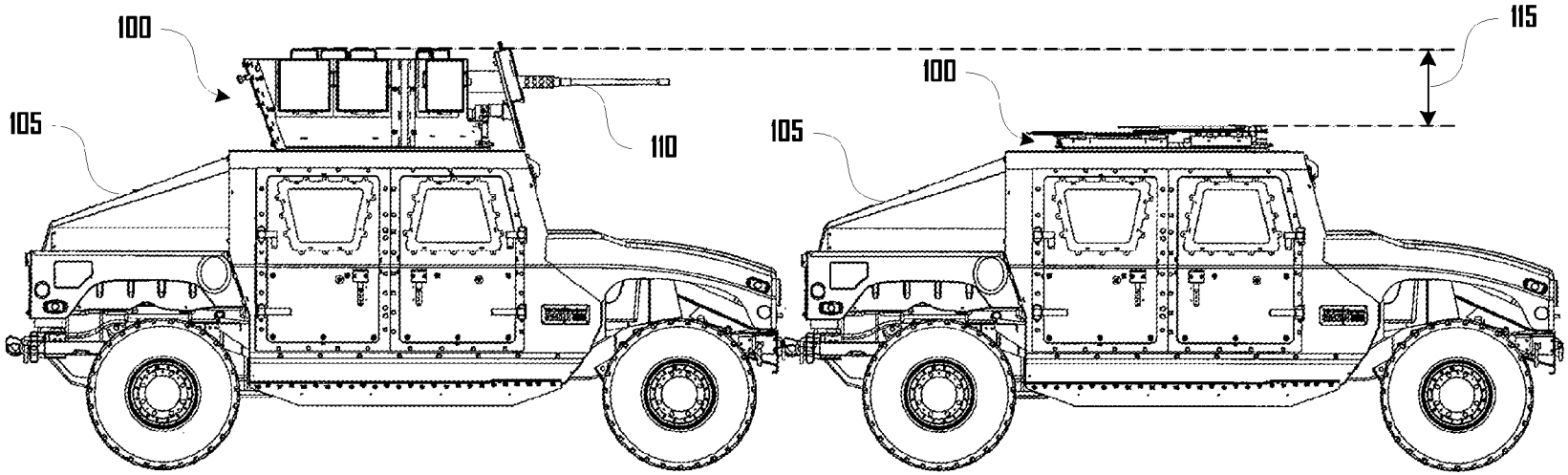
FIG. 1*a* is an exemplary side view drawing illustrating an embodiment of a combat vehicle having an inward-folding protective turret system in an erected configuration.
FIG. 1*b* is an exemplary side view drawing illustrating the combat vehicle of FIG. 1 wherein the inward-folding protective turret system is in a collapsed configuration.

It should be noted that the figures are not drawn to scale and that elements of similar structures or functions are generally represented by like reference numerals for illustrative purposes throughout the figures. It also should be noted that the figures are only intended to facilitate the description of the preferred embodiments. The figures do not illustrate every aspect of the described embodiments and do not limit the scope of the present disclosure.

DETAILED DESCRIPTION OF THE PREFERRED EMBODIMENTS

Since currently-available protective turret systems are deficient because they fail to provide for adequate collapsibility and height reduction, an inward-folding protective turret system that provides improved collapsibility and substantial height reduction, without compromising protective strength and features, can prove desirable and provide a basis for a wide range of improved vehicle turret systems. This result can be achieved, according to one embodiment disclosed herein, by a modular turret extension system as illustrated in FIG. 1*a*-FIG. 7*e*.

Turning to FIGS. 1*a* and 1*b*, a protective turret 100 is shown coupled to the top of a combat vehicle 105. FIG. 1*a* depicts the protective turret 100 in an erected configuration and FIG. 1*b* depicts the protective turret 100 in a collapsed configuration. Collapsing the protective turret 100 results in a height reduction 115, which may be desirable for purposes of transportation, where cargo space is limited. For example, combat vehicles may be transported to theatre or between combat zones via aircraft, ship, boat or truck where such a vehicle has limited height and width for transporting cargo. Additionally, many transport vehicles are configured for vehicles of standardized size, and may not be able to easily accommodate vehicle cargo that is substantially larger than a standard height and width. Accordingly, the height reduction 115 may be important for vehicle transport.

The height reduction generated by collapsing the protective turret 100, and the height of the erected protective turret 100, and the height of the collapsed turret 100 may be various heights according to various embodiments. For example, in one embodiment the height reduction may be about 19 and 3/32 inches with the collapsed protective turret 100 having a height of about 5 and 9/16 inches and the erected protective turret 100 having a height of about 24 and 5/8 inches above the roof of the combat vehicle 105.

FIG. 1*a* depicts a Browning M2 .50 caliber machine gun system 110 as part of the erected protective turret 100. However, weapon systems of various types may be used with the protective turret 100, including one or more, small arms, light machine guns (LMG), heavy machine guns (HMG), artillery, grenade launchers, rocket launchers, missile launchers, or the like, without limitation. Such systems may include a Remote Weapons System (RWS) or a weapons system that is directly operated by a gunner. Additionally, non-weapons systems may also be used with the protective turret 100, including a surveillance system, non-lethal weapons system, targeting system, or the like, without limitation. In some embodiments, the protective turret 100 may be used without a weapons system or the like.

The protective turret 100 may be configured to modularly couple with a standard HMMWV roof ring mount and configured to modularly couple with systems configured for use with a standard HMMWV roof ring mount. For example, U.S. patent application Ser. No. 12/899,413 (filed May 21, 2013) teaches a modular turret extension that may be used with the protective turret 100.

While a standard HMMWV roof ring mount is used as an example in the present disclosure (See e.g., FIG. 2), other standard ring mounts, non-standard ring mounts, or mounts of other shapes may be accommodated by a protective turret 100 in accordance with some embodiments. Mounts and coupling architecture may comprise various suitable structures including bolts, bolt holes, pins, slots, hooks, flanges, or the like without limitation.

Additionally, although FIGS. 1*a* and 1*b* depict the protective turret 100 coupled to a HMMWV vehicle 105, in some embodiments, the protective turret 100 may be used on, or configured for use on, various other types of combat vehicles, including armored personnel carriers (APCs), main and light tanks, and infantry fighting vehicles. In further embodiments, the protective turret 100 may be used on, or configured for use on other types of vehicles, including boats, ships and aircraft. The presently disclosed embodiments are only intended to show some of the numerous embodiments of the protective turret 100 and applications thereof.

Figure 2:
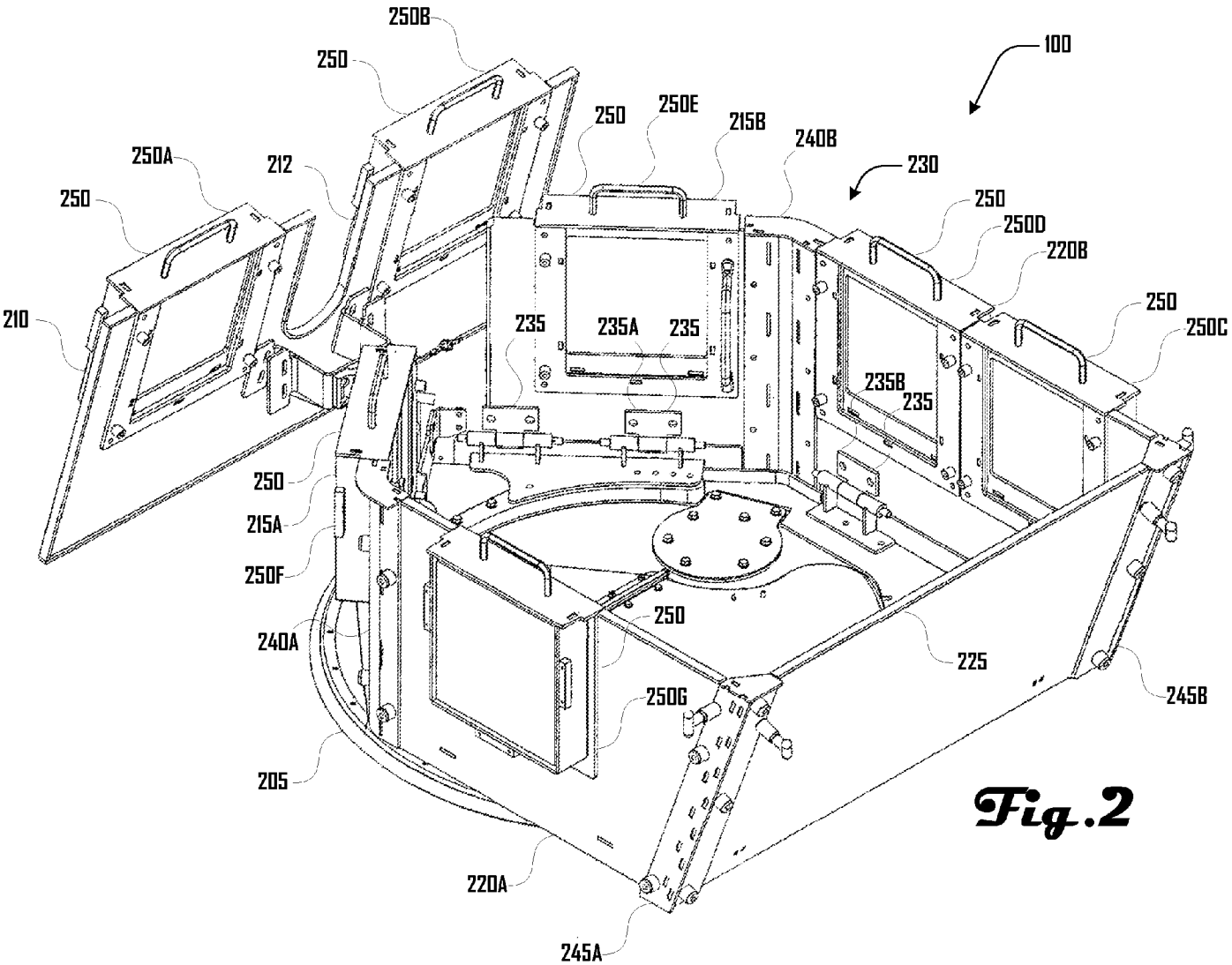
FIG. 2 is an exemplary perspective view drawing illustrating an embodiment of an inward-folding protective turret system.

FIG. 2 depicts the protective turret 100 in an erected configuration with the weapons system 110 (shown in FIG. 1*a*) removed. The protective turret 100 comprises a turret base 205 with a forward gunner shield 210, a first pair of turret panels 115A, 115B, a second pair of turret panels 220A, 220B and a rear turret panel 225, which collectively may define a turret compartment 230.

Each of the turret panels 215A, 215B, 220A, 220B, 225 may be rotatably connected to the turret base 205 proximate to a portion of an edge of the turret base 205 with one or more hinges 235. For example, turret panel 215B is rotatably coupled to the turret base 205 via two hinges 235 including hinge 235A and turret panel 220B is rotatably coupled to the turret base 205 via two hinges 235 including hinge 235B. In various embodiments, a protective turret 100 may comprise any suitable number of turret panels, which may be rotatably coupled via one or more hinges 235 or any other suitable rotatable coupling assembly.

In an erected configuration the turret panels 215A, 215B, 220A, 220B, 225 may extend away from the turret base 205 with respective edges of the turret panels 215A, 215B, 220A, 220B, 225 being adjoining and coupled by coupling joints 240A, 240B, 245A, 245B. For example, in the present example embodiment, coupling joint 240A couples turret panels 215A and 220A; coupling joint 245A couples turret panels 220A and 225; coupling joint 245B couples turret panels 225 and 220B; and coupling joint 240B couples turret panels 220B and 215B.

FIG. 2 depicts an embodiment where turret panels 215A, 215B, 220A and 220B extend substantially perpendicularly away from the turret base 205 and are rigidly coupled by coupling joints 240A, 240B, with the rear turret panel 225 extending from the turret base 205 at an angle greater than 90° and being rigidly coupled with turret panels 220A, 220B via coupling joints 245A, 245B. However, various embodiments may include any suitable number of coupling joints and turret panels, with the turret panels being rigidly held at any suitable angle relative to the turret base 205.

Additionally, FIG. 2 depicts turret panels 215A, 215B being symmetrically opposing on respective sides of the turret base 205, with turrets panels 220A, 220B also being symmetrically opposing on respective sides of the turret base 205. Such a configuration is only one example embodiment, and further embodiments may comprise any suitable number turret panels that may or may not be symmetrically disposed about the turret base 205.

Portions of the protective turret 100 may include one or more window cassettes 250. As described in further detail herein, in some embodiments, window cassettes 250 may be removable and of a standard size and shape such that they may be easily replaced or switched with other window cassettes 250 in the protective turret 100.

As shown in FIG. 2, the forward gunner shield 210 may comprise a first and second window cassette 250A, 250B disposed on opposing sides of a barrel slot 212. This configuration may be desirable because it allows the barrel of a weapons system 110 (FIG. 1) to extend through or to the barrel slot 212 from within the turret compartment 230 and provide a gunner a protected line of sight to the left and right of the barrel of the weapons system 110.

The turret panels 215A, 215B, 220A, 220B, 225 may include one or more window cassette 250 or may not include a window cassette 250. For example, in the embodiment depicted in FIG. 2, turret panels 215A, 215B and 220A each have a single window cassette 250 disposed therewithin (i.e., window cassettes 250F, 250E and 250G respectively). Turret panel 220B is shown with two window cassettes 250 (i.e., window cassettes 250C and 250D). The rear turret panel 225 is shown without a window cassette 250. In further embodiments, window cassettes 250 may be replaced with an opaque cassette (not shown), or the like. Additionally, in some embodiments, the shape and size of window cassettes 250 may be the same, may be different, or there may be two or more standard sizes of window cassettes 250 in some embodiments.

FIG. 3 depicts a configuration of the protective turret 100 with the window cassettes 250 removed and shows a plurality of cassette slots 350 in which the window cassettes (FIG. 2) may be removably disposed. For example, referring to FIGS. 2 and 3, window cassette 250C may be disposed in cassette slot 350C; window cassette 250D may be disposed in cassette slot 350D; window cassette 250E may be disposed in cassette slot 350E; window cassette 250F may be disposed in cassette slot 350F; window cassette 250G may be disposed in cassette slot 350G.

However, as discussed herein, window cassettes 250 may be replaceable and modular. For example, if the protective turret 100 comes under fire and window cassette 250G is damaged such that its transparent armor is no longer sufficiently transparent, window cassette 250G may be removed from cassette slot 350G and swapped with window cassette 250C, which may be undamaged. This may be desirable because both the left and right turret panel 220A, 220B will then have operable cassette windows 250, which may improve situational awareness within the protective turret 100. This may be further desirable in combat situations where there is not access to replacement window cassettes 250, yet battlefield conditions require fast reconfiguration of the window cassettes 250. When replacement cassettes 250 are available however, damaged window cassettes 250 may be replaced.

As discussed in more detail herein, the windows may comprise a transparent armor along with an armored frame. Other portions of the protective turret 100 may be armored or comprise ballistic-resistant properties. For example, parts such as the turret panels 215A, 215B, 220A, 220B, 225, coupling joints 240, 245, window cassettes 250, turret base 205, forward gunner shield 210 or the like, may comprise armor steel or other suitable material. In some embodiments, portions of, or the protective turret 100 as a whole, may conform to United States Department of Defense (DoD) specifications for opaque armor, or other specifications, or requirements, or standards for opaque armor, or the like.

Figure 3A:
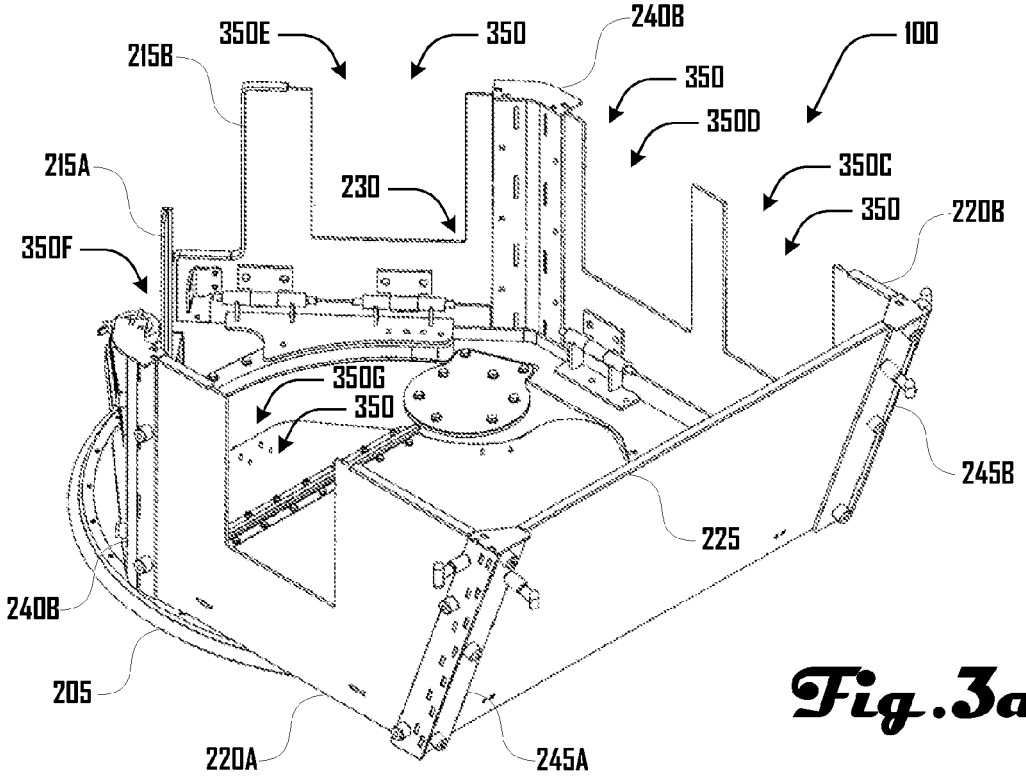
FIG. 3*a* is an exemplary perspective view drawing illustrating the inward-folding protective turret system of FIG. 2 in a first collapsing configuration.
Figure 3B:
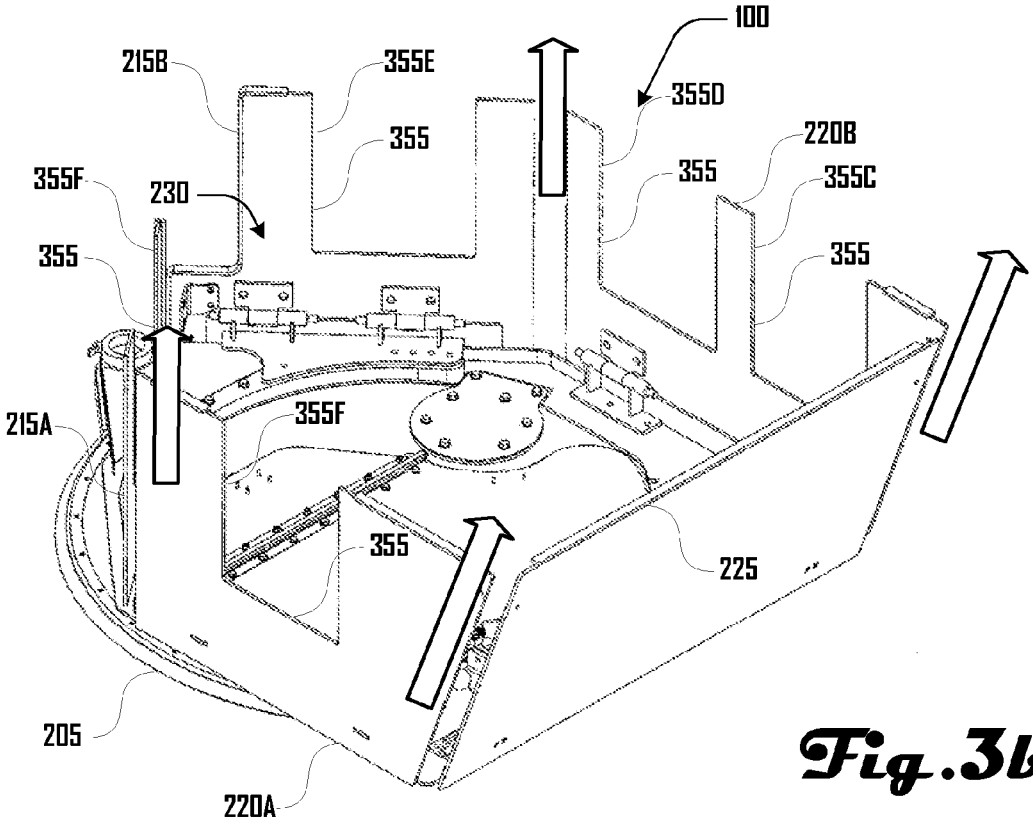
FIG. 3*b* is an exemplary perspective view drawing illustrating the inward-folding protective turret system of FIG. 2 in a second collapsing configuration.

As discussed above, the protective turret 100 may be collapsible. FIGS. 2 and 3*a*-3*f* depict one example of how the protective turret 100 may be sequentially transitioned from an erected configuration (e.g., FIG. 1*a*) to a collapsed configuration (e.g., FIGS. 1*b*, 4*a* and 4*b*). FIG. 1*a* depicts a protective turret 100 having a weapons system 110. FIG. 2 depicts a first step, wherein the weapons system 110 (FIG. 1*a*) is removed. FIG. 3*a* depicts a second step wherein the forward gunner shield 210 (FIG. 2) and window cassettes 250 are removed from the cassette slots 350. FIG. 3*b* depicts a third step wherein the coupling joints 240A, 240B, 245A, 245B are removed.

Figure 3C:
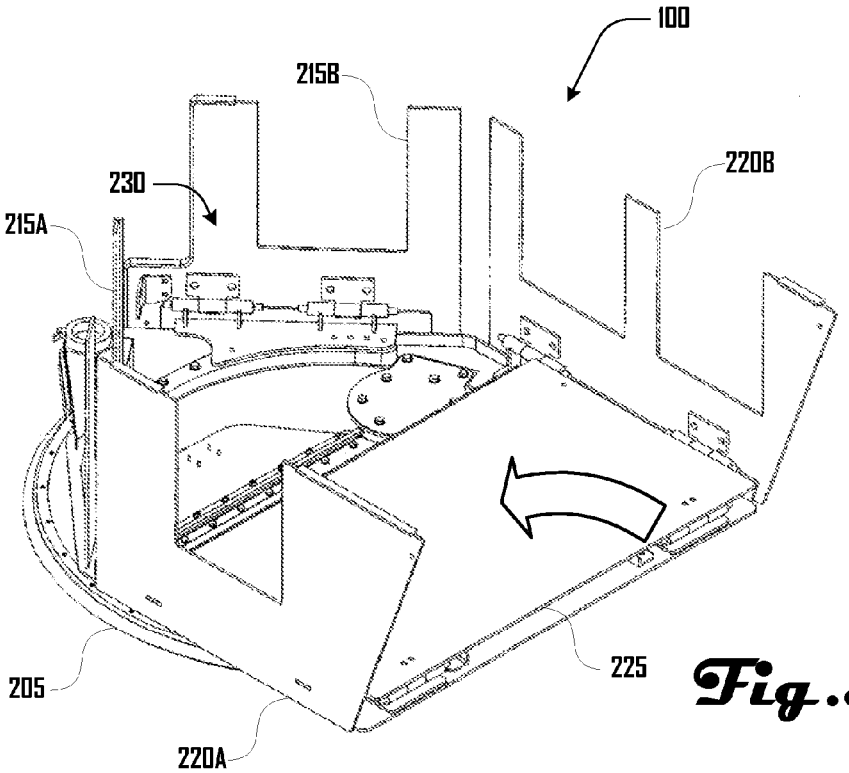
FIG. 3*c* is an exemplary perspective view drawing illustrating the inward-folding protective turret system of FIG. 2 in a third collapsing configuration.
Figure 3D:
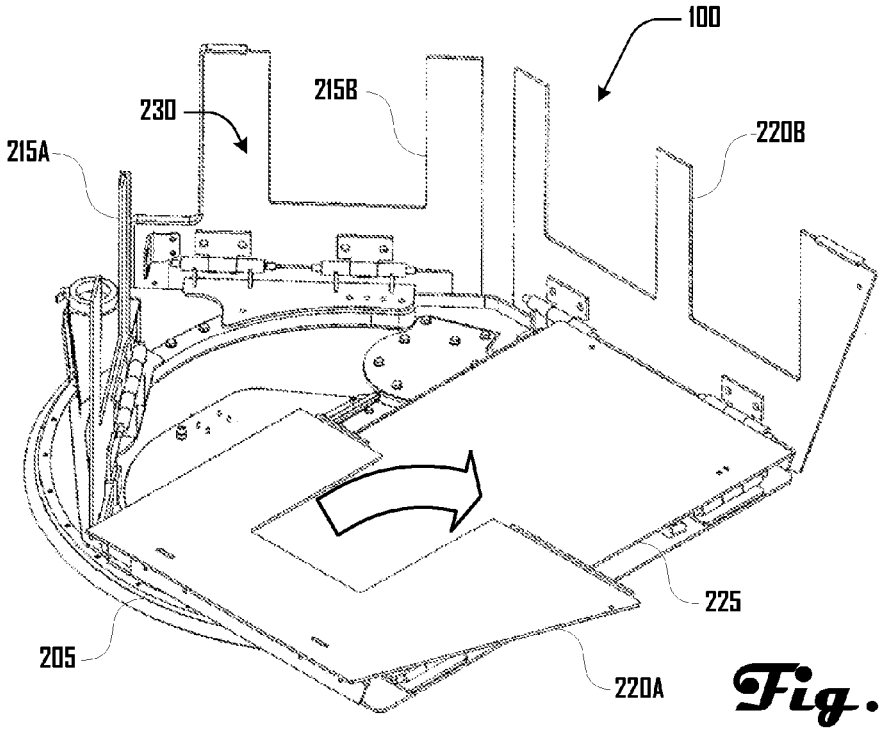
FIG. 3*d* is an exemplary perspective view drawing illustrating the inward-folding protective turret system of FIG. 2 in a fourth collapsing configuration.

FIG. 3*c* depicts a fourth step wherein the rear turret panel 225 is folded inward within the turret compartment 230 and toward the turret base 205. The rear turret panel 225 is folded to a position that is substantially parallel to the turret base 205. FIG. 3*d* depicts a fifth step wherein turret panel 220A is folded inward toward the turret base 205. Turret panel 220A is folded to a position that is substantially parallel to the turret base 205 and also parallel to and over the rear turret panel 225. Accordingly, to provide for such a configuration, turret panel 220A is rotatably coupled to the turret base 205 at a height greater than the height at which the rear turret panel 225 is coupled to the turret base 205.

Figure 3E:
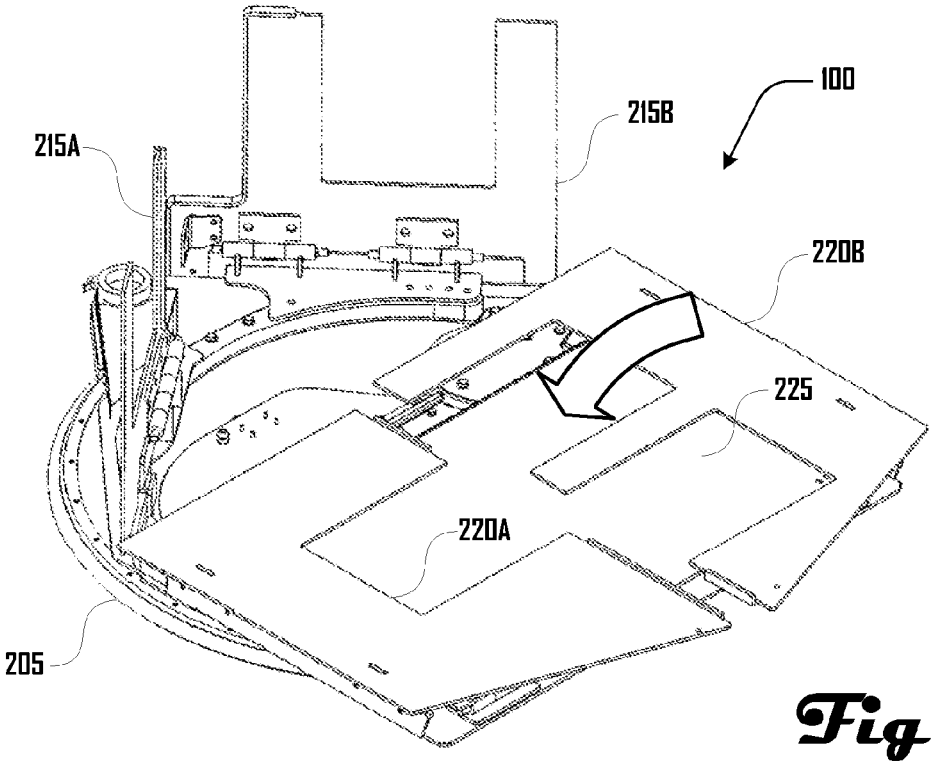
FIG. 3*e* is an exemplary perspective view drawing illustrating the inward-folding protective turret system of FIG. 2 in a fifth collapsing configuration.

FIG. 3*e* depicts a sixth step wherein turret panel 220B is folded inward toward the turret base 205. Turret panel 220B is folded to a position that is substantially parallel to the turret base 205 and also parallel to and over the rear turret panel 225. Accordingly, to provide for such a configuration, turret panel 220B is rotatably coupled to the turret base 205 at a height greater than the height at which the rear turret panel 225 is coupled to the turret base 205. The height of turret panel 220B may be greater than or substantially equal to the height of turret panel 220A given that turret panel 220B does not overlap with turret panel 220A.

Figure 3F:
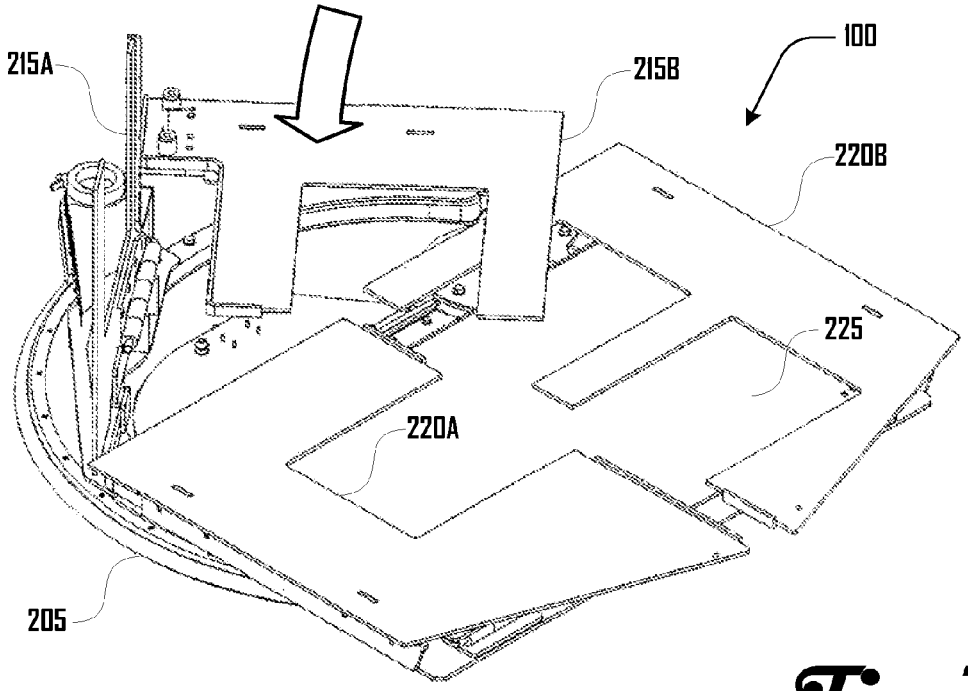
FIG. 3*f* is an exemplary perspective view drawing illustrating the inward-folding protective turret system of FIG. 2 in a sixth collapsing configuration.

FIG. 3*f* depicts a seventh step wherein turret panel 215B is folded inward toward the turret base 205. Turret panel 215B is folded to a position that is substantially parallel to the turret base 205 and also parallel to, and over, the rear turret panel 225 and parallel to turret panel 220B. Accordingly, to provide for such a configuration, turret panel 215B is rotatably coupled to the turret base 205 at a height greater than the height at which the rear turret panel 225 is coupled to the turret base 205 and at a height that is greater that turret panel 220A and 220B.

Figure 3G:
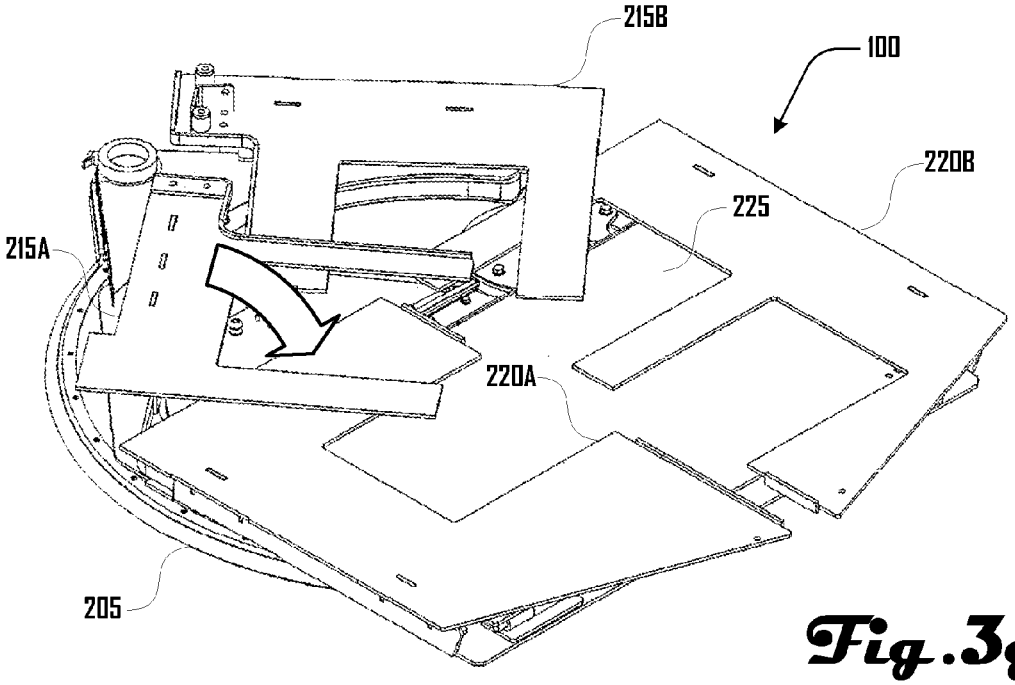
FIG. 3*g* is an exemplary perspective view drawing illustrating the inward-folding protective turret system of FIG. 2 in a seventh collapsing configuration.

FIG. 3*g* depicts an eighth step wherein turret panel 215A is folded inward toward the turret base 205. Turret panel 215A is folded to a position that is substantially parallel to and over the turret base 205 and also parallel to and over the rear turret panel 225, turret panel 220A, turret panel 220B and turret panel 215B. Accordingly, to provide for such a configuration, turret panel 215A is rotatably coupled to the turret base 205 at a height greater than the height at which the rear turret panel 225 is rotatably coupled to the turret base 205 and at a height that is greater than turret panels 220A, 220B, and 215B are rotatably coupled to the turret base 205.

Figure 4A:
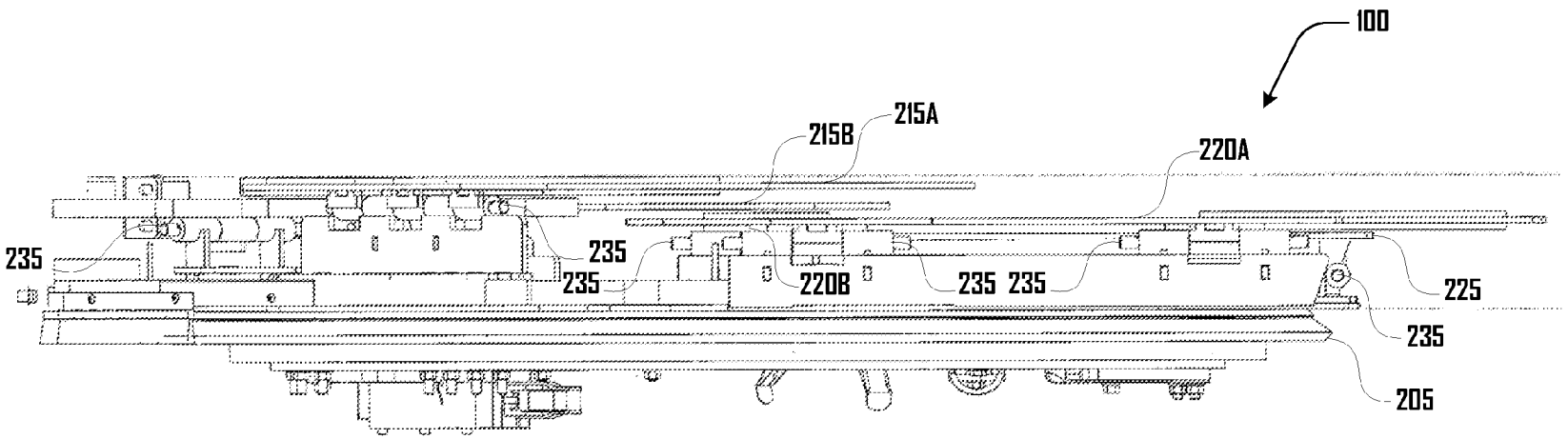
FIGS. 4*a* and 4*b* are an exemplary side view drawing illustrating the inward-folding protective turret system of FIG. 2 in a collapsed configuration.
Figure 4B:
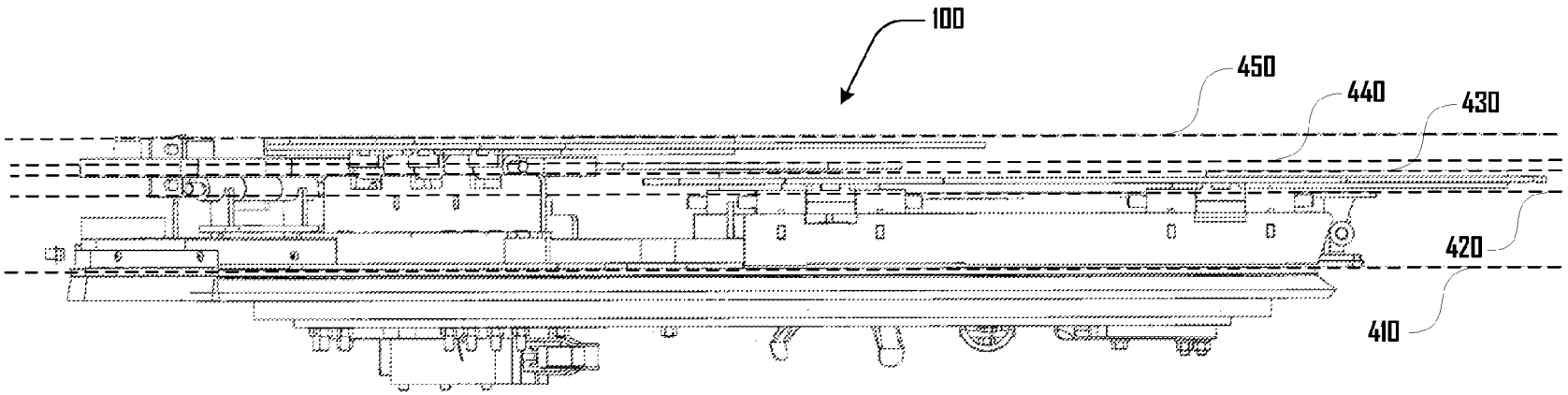

FIGS. 4*a* and 4*b* depict the same side view of the protective turret 100 with different figure labels for purposes of clarity. FIGS. 4*a* and 4*b* depict the turret panels 215A, 215B, 220A, 220B, 225 at respective heights above, and parallel to, the turret base 205. A top surface of the turret base is shown at plane 410; a top surface of the rear turret panel 225 is shown at first height 420; top surfaces of turret panels 220A and 220B are shown at second height 430; a top surface of turret panel 215B at a third height 440; and a top surface of turret panel 215A at a fourth height 450.

Figure 5B:
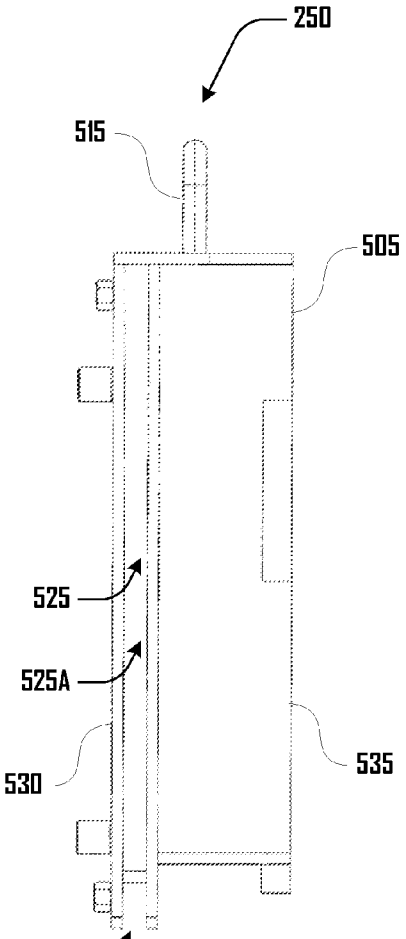
FIG. 5*b* is an exemplary side view drawing illustrating the window cassette of FIG. 5*a*.
Figure 5A:
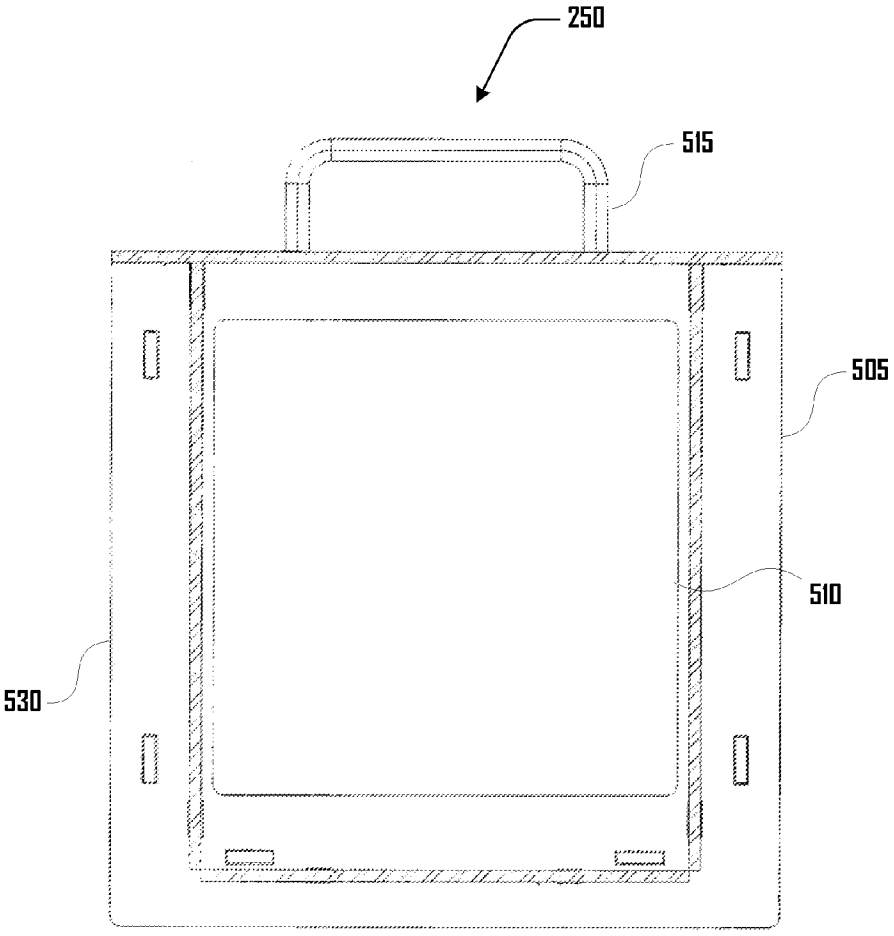
FIG. 5*a* is an exemplary face view drawing illustrating a window cassette in accordance with an embodiment.
Figures 7A, 7B, 7C, 7D, 7E:
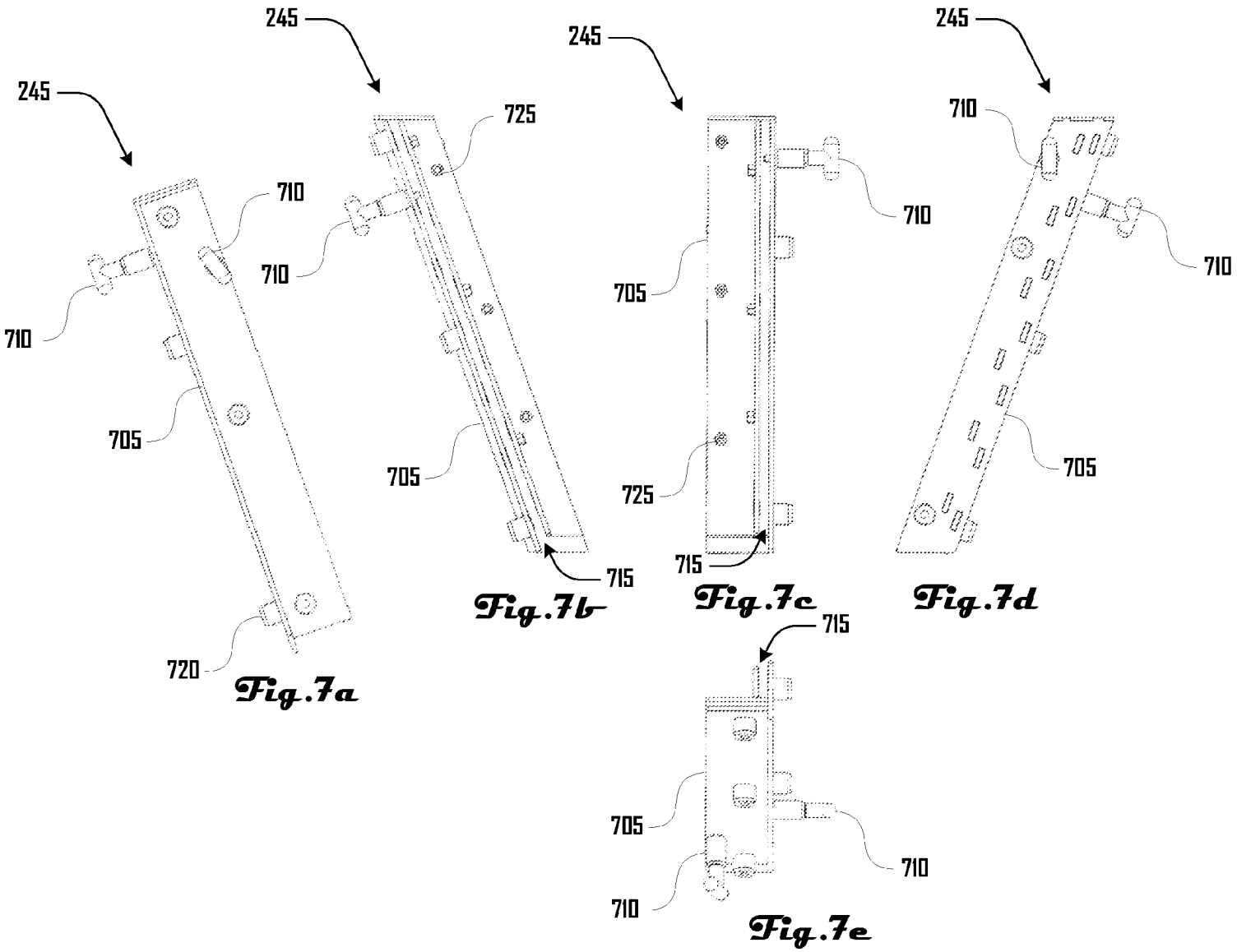
FIG. 7*a* is an exemplary side view drawing illustrating a coupling joint in accordance with a first embodiment.
FIG. 7*b* is an exemplary side view drawing illustrating a coupling joint in accordance with a second embodiment.
FIG. 7*c* is another exemplary side view drawing illustrating the coupling joint depicted in FIG. 7*a*.
FIG. 7*d* is another exemplary side view drawing illustrating the coupling joint depicted in FIG. 7*b*.
FIG. 7*e* is an exemplary bottom view drawing illustrating a coupling joint in accordance with an embodiment.

FIGS. 5*a* and 5*b* respectively depict a face and side view of a window cassette 250 in accordance with an embodiment. The window cassette 250 comprises a cassette body 505 that surrounds a window pane 510. In some embodiments, the window pane 510 may comprise ballistic glass, transparent armor, bullet-resistant glass, or the like, without limitation. For example, the window pane 510 may be constructed using polycarbonate, thermoplastic, and layers of laminated glass or plastic. Products such as Armormax, Makroclear, Cyrolon, Lexan and Tuffak are examples of products that may be suitable to comprise the window pane 510. The window pane 510 may conform to the DoD specifications for transparent armor, or other specifications, or requirements, or standards for transparent armor, or the like.

Because the protective turret 100 may be exposed to combat situations, it may be desirable for window panes 510 and/or window cassettes 250 to be removable or replaceable in situations where window panes 510 and/or window cassettes 250 are damaged by projectiles, explosives, or the like. The window cassette 250 may comprise side slots 525 and a bottom slot 520 that correspond to and engage the edges 355 of a cassette slot 350 such that the edges 355 reside within the slots 520, 525. In some embodiments, the armor properties of the window pane 510 require one face of the window pane 510 to face toward the source of projectiles or a blast. Accordingly, the window cassette 250 may have an inward face 530 (i.e., preferably facing toward the turret compartment 230) and an outward face 535 (i.e., preferably facing away from the turret compartment 230).

FIGS. 6*a*-6*c* depict side and bottom views of a coupling joint 240 in accordance with an embodiment, which includes a joint body 605, a plurality of internal jam bolts 610 on an internal face 615 and a plurality of external jam bolts 620 on an external face 625. The joint body 605 defines a first and second joint slot 630A, 630B. The coupling joint 240 further comprises a cap plate 535 at a top end of the coupling joint 240.

As discussed herein, coupling joint 240 may be used to rigidly couple adjoining edges of turret panels. Such adjoining edges may respectively reside within the slots 360, and may be held by one or more of the jam bolts 610, 620. In various embodiments, coupling joints are configured to be easily and quickly removed from or applied to a protective turret 100. For example, the jam bolts 610, 620 may be configured to be hand-tightened or tightened with a standard wrench or other tool. This may be desirable so that the protective turret 100 can be quickly erected or collapsed in hostile combat environments where access to tools may be limited. Additionally, having turret panel edges disposed within slots 360 may be desirable so as to improve resistance to penetration by projectiles or a blast.

FIGS. 7*a*-7*e* depict a coupling joint 245 in accordance with further embodiments, which may be configured for angled or perpendicularly rigid coupling of adjoining turret panels. The coupling joint 245 comprises a joint body 705, a plurality of pin bolts 710, a joint slot 715, a plurality of external jam bolts 720, and a plurality of internal jam bolts 725. As discussed above in relation to coupling joints 240, the coupling joints 245 depicted in FIGS. 7*a*-7*c* may be configured to be easily and quickly removed and applied to a protective turret 100. For example, the jam bolts 610, 620 may be configured to be hand-tightened or tightened with a standard wrench or other tool. This may be desirable so that the protective turret 100 can be quickly erected or collapsed in hostile combat environments where access to tools may be limited. Additionally, having turret panel edges disposed within the joint slot 715 may be desirable so as to improve resistance to penetration by projectiles or a blast.

While specific embodiments and configurations of coupling joints 240, 245 and turret panels 215A, 215B, 220A, 220B, 225 are shown and described herein, these configurations are merely one example embodiment of the present invention, and should not be construed to limit the numerous variations that are within the scope and spirit of the present invention.

Accordingly, the described embodiments are susceptible to various modifications and alternative forms, and specific examples thereof have been shown by way of example in the drawings and are herein described in detail. It should be understood, however, that the described embodiments are not to be limited to the particular forms or methods disclosed, but to the contrary, the present disclosure is to cover all modifications, equivalents, and alternatives.

The invention claimed is:

1. A protective turret comprising:

a turret base; and at least three turret panels, each rotatably coupled proximate to a portion of an edge of the turret base, the turret panels operable to assume an erected configuration with each of the turret panels extending away from the turret base and defining a turret compartment defined by a portion of the turret base and a portion of the at least three turret panels, and the turret panels further operable to assume a collapsed configuration by each of the turret panels folding inward within the turret compartment toward the turret base such that the turret panels are stacked at sequentially greater heights above the face of the turret base.

2. The protective turret of claim 1, wherein the turret base and turret panels are substantially parallel in the collapsed configuration.

3. The protective turret of claim 1, wherein at least one of the turret panels comprises a window pane.

4. The protective turret of claim 3, wherein the window pane is disposed in a removable window cassette with the window cassette residing within a first cassette slot defined by a portion of the at least one turret panel.

5. The protective turret of claim 4, further comprising a second cassette slot, and wherein the removable window cassette is configured to reside within the second cassette slot.

6. The protective turret of claim 1, wherein at least two of the turret panels are configured to be coupled at adjoining edges by at least one coupling joint.

7. The protective turret of claim 6, wherein the coupling joint is configured to rigidly couple the at least two turret panels in the erect configuration, and wherein the at least one coupling joint is removable.

8. The protective turret of claim 6, wherein the at least one coupling joint couples the at least two turret panels via at least one bolt.

9. The protective turret of claim 1, wherein the turret base is configured to couple with the roof of a vehicle.

10. The protective turret of claim 9, wherein the vehicle is a HMMWV.

11. The protective turret of claim 9, wherein the turret base is coupled with the roof of the vehicle via a standard ring mount.

12. The protective turret of claim 1, further comprising a removable forward gunner shield.

13. The protective turret of claim 1, comprising five turret panels.

14. The protective turret of claim 13, comprising two pairs of symmetrically opposing side turret panels and a rear turret panel disposed between at least one pair of the symmetrically opposing side turret panels.

15. The protective turret of claim 1 wherein at least two of the turret panels are rotatably coupled to the turret base at different distances from the turret base such that the at least two panels are operable to assume a stacked configuration with the at least two turret panels parallel to the turret base.

16. A method of collapsing an erected turret having a turret base and a plurality of turret panels, each rotatably coupled proximate to a portion of an edge of the turret base, the turret panels in an erected configuration with each of the turret panels extending away from the turret base and defining a turret compartment defined by a portion of the turret base and a portion of the plurality of turret panels, the method comprising:

folding a first turret panel inward within the turret compartment and toward the turret base until the first turret panel is substantially parallel with a face of the turret base;

folding a second turret panel inward within the turret compartment and toward the turret base until the second turret panel is substantially parallel with the face of the turret base; and folding a third turret panel inward toward the turret base until the third turret panel is substantially parallel with the face of the turret base, wherein the first, second and third turret panel are stacked at sequentially greater heights above the face of the turret base.

17. The method of claim 16, wherein a portion of the first turret panel is stacked between a portion of the turret base and the second turret panel.

* * * * *